US005425298A

United States Patent [19]

Coburn

[11] Patent Number: 5,425,298

[45] Date of Patent: Jun. 20, 1995

[54] ADJUSTABLE MUZZLE BRAKE FOR A FIREARM

[75] Inventor: Ronald Coburn, Westfield, Mass.

[73] Assignee: Challenger International Ltd., Hamilton HMFX, Bermuda

[21] Appl. No.: 200,465

[22] Filed: Feb. 23, 1994

[51] Int. Cl.[6] ..... F41A 21/38

[52] U.S. Cl. ..... 89/14.3

[58] Field of Search ..... 42/79; 89/14.2, 14.3, 89/14.4

[56] References Cited

U.S. PATENT DOCUMENTS

| | | | |
|---|---|---|---|
| 618,901 | 2/1899 | Peterson | 89/14.3 |
| 2,191,484 | 2/1940 | Hughes | 89/14.3 |
| 2,484,998 | 10/1949 | Hutchinson | 89/14.3 |
| 2,558,200 | 6/1951 | Schmeling | 42/79 |
| 2,712,193 | 7/1955 | Mathis | 42/79 |
| 2,859,444 | 11/1958 | Reymond | 89/14.3 |
| 2,883,781 | 4/1959 | Harvey | 89/14.3 |
| 3,021,633 | 2/1962 | Beretta | 89/14.3 |
| 3,971,285 | 7/1976 | Ellis et al. | 89/14.3 |
| 4,374,484 | 2/1983 | Bekker et al. | 89/14.3 |
| 4,459,895 | 7/1984 | Mazzanti | 89/14.3 |
| 4,635,528 | 7/1987 | McQueen | 89/14.3 |
| 5,333,529 | 8/1994 | Brockman | 89/14.3 |

FOREIGN PATENT DOCUMENTS

| | | | |
|---|---|---|---|
| 578369 | 6/1958 | Italy | 89/14.3 |
| 240479 | 4/1946 | Switzerland | 89/14.3 |

*Primary Examiner*—Stephen C. Bentley
*Attorney, Agent, or Firm*—Richard H. Kosakowski; Holland & Associates

[57] ABSTRACT

A rifle has an adjustable muzzle brake attached to a muzzle end of the rifle, the muzzle brake including an inner sleeve surrounded by an outer sleeve. The two sleeves are rotatable with respect to each other and have a pattern of holes formed in each. A pair of detent mechanisms formed in the inner and outer sleeves allow the outer sleeve to rotate to a first position with respect to the inner sleeve where the holes of both sleeves are aligned with each other. In this position the gases of combustion can escape through the aligned holes in both sleeves in a substantially transverse direction to the axis of the gun barrel. This provides for a significant reduction in the amount of recoil force on the shooter of the rifle. The detent mechanisms also allow the outer sleeve to be rotatable to a second position where the holes of the inner and outer sleeves are totally out of alignment with each other. In this position the gases are not allowed to escape transversely to the axis of the gun barrel, but instead follow the bullet out the muzzle end of the muzzle brake.

13 Claims, 2 Drawing Sheets

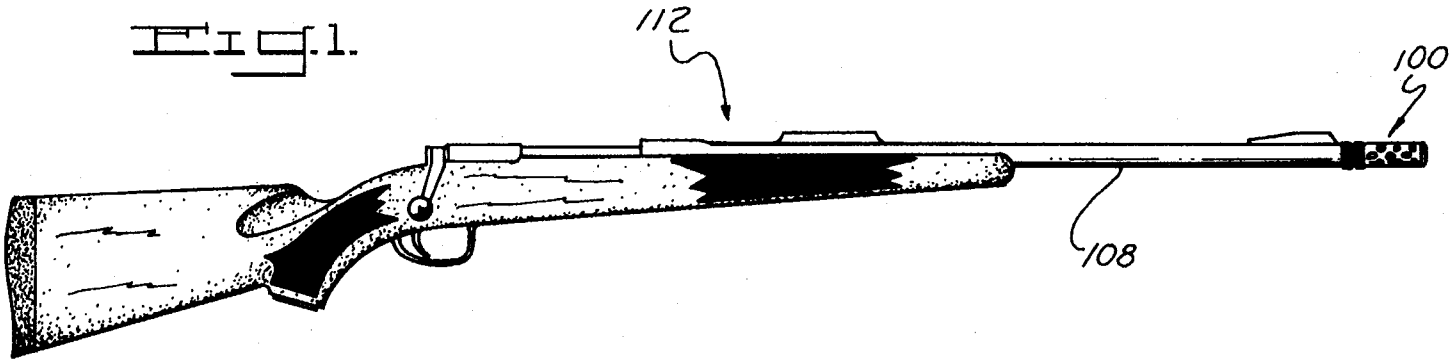
Fig. 1.
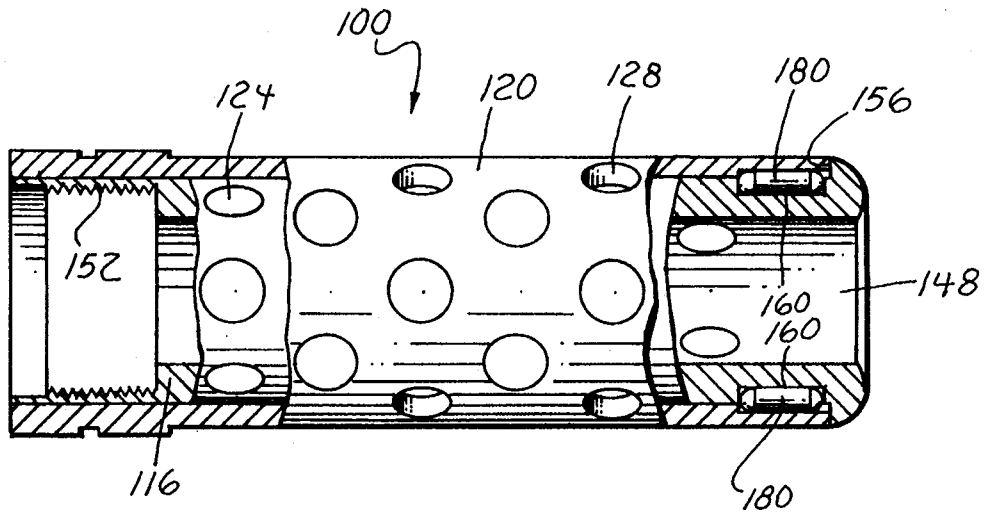
Fig. 2.
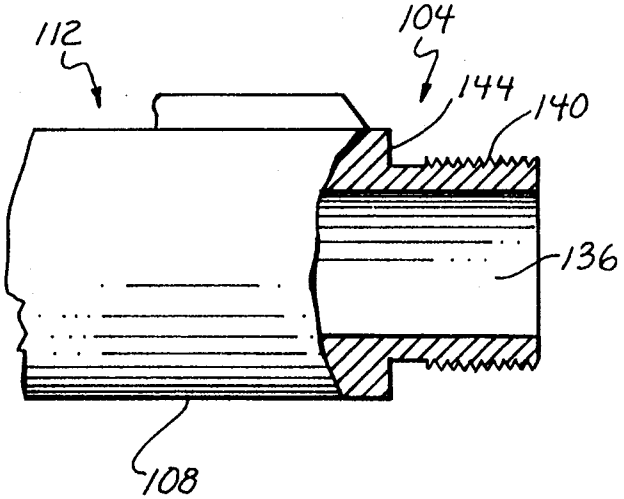

ADJUSTABLE MUZZLE BRAKE FOR A FIREARM

BACKGROUND OF THE INVENTION

This invention relates to firearms, and more particularly to an adjustable muzzle brake for a rifle which reduces the recoil reaction force on the shooter.

It is well-known that the shooter of a firearm, such as a rifle, shotgun or handgun, experiences a recoil or reaction force when the gun is fired. The recoil is directed in an opposite direction to the path of the bullet or shot as it travels down the barrel of the firearm. Because a firearm is typically supported by a shooter in a standing position and sometimes off to the right or left side of the shooter's body at the shooter's shoulder, waist or other body position, the recoil force also causes the gun barrel to climb, often at an angle with respect to the vertical, for example, forty-five degrees (i.e., "muzzle climb") The amount of linear and angular movement of the gun on account of the recoil force varies due to the different physical and psychological characteristics of the shooter and the position of the firearm in relation to the shooter's body. This recoil force can be physically unpleasant to endure and can cause inaccuracies in the shooter's aim.

The prior art is replete with attempts to reduce the amount of the recoil force and/or the muzzle climb, with the greater goals of making the firearm more accurate and physically pleasant to shoot. Most, if not all, of the devices vent the expanding gases resulting from the explosion of the gunpowder or similar material, in one or more predetermined directions that run counter to the direction of the recoil and/or the muzzle climb. See, for example, U.S. Pat. No. 2,191,484 to Hughes, which describes a recoil elimination device having a series of gas discharge ports and baffle ports. Both types of ports vent the gases in directions substantially transverse to the axis of the gun barrel. An adjustable sleeve is provided to cover a portion or all of one or both types of ports, thereby varying the amount of gas venting, resulting in varying degrees of recoil control.

U.S. Pat. No. 4,459,895 to Mazzanti describes a recoil reducing device that has a tubular member with a plurality of slots formed in the radial wall of the member. Semi-circular baffle members are longitudinally spaced along the tubular member and have circular cut-outs at their centers to allow the fired bullet to pass through. The baffle members are sequentially rotated at approximately ninety degrees with respect to each other. A sleeve is disposed over the outer surface of the tubular member. The sleeve also has apertures cut therein. This complex design results in a helical flow of the gas through the length of the tubular member before the gas exits the lateral apertures of the tubular member and sleeve.

U.S. Pat. No. 3,971,285 to Ellis et al. discloses an adjustable muzzle compensator having a plurality of apertures formed in its housing to allow gas to be diverted out of the apertures in radial directions transverse to the axis of the gun barrel. The compensator is adjustable for accurate indexing of the apertures such that the resulting direction of the diverted gas is opposite to the direction of muzzle climb.

U.S. Pat. No. 4,635,528 to McQueen discloses a stabilizer for a firearm such as a rifle. The stabilizer is attached to the firearm muzzle to control muzzle climb by adjusting both the magnitude and direction of the forces that counter muzzle climb. The stabilizer enables a controlled amount of gas to escape through ports and slots oriented transverse to the gun barrel. The stabilizer and the slots can be adjusted to direct the force of the escaping gases to be counter to the direction of muzzle climb. The magnitude of the counter force can also be adjusted by varying the amount of openings of the slots and ports. Another muzzle climb compensator is described in U.S. Pat. No. 4,374,484 to Bekker et al.

It is also well-known that muzzle brakes having holes to allow the gas to escape transverse to the gun barrel also have an effect on the shot pattern of a shotgun. This is because the transversely escaping gas exerts less force on the plurality of shot pellets exiting the muzzle, which produces a more compact shot pattern. See, for example, U.S. Pat. Nos. 618,901, 2,484,998, 2,558,200 and 2,712,193. The '998 and '193 patents also recognize the fact that the transversely escaping gases have the added effect of reducing recoil.

However, heretofore, no known adjustable device for reducing solely the linear recoil has been provided for a rifle and having a simple mechanism for rotatably choosing between a recoil reduction mode and a non-recoil reduction mode.

Accordingly, it is a primary object of the present invention to provide a muzzle brake for a firearm, primarily a rifle, for reducing the linear recoil associated with the firing of the rifle.

It is a general object of the present invention to provide an adjustable muzzle brake that has a quick locator detent mechanism that makes the muzzle brake easily rotatably adjustable between an open position where recoil is reduced and a closed position where recoil is not reduced.

It is a further object of the present invention to provide an adjustable muzzle brake that is provided by the gun manufacturer as an integral part of the firearm, instead of aftermarket which usually necessitates modifying the muzzle end of the gun barrel to accommodate the attachment of the aftermarket muzzle brake.

The above and other objects and advantages of this invention will become more readily apparent when the following description is read in conjunction with the accompanying drawings.

SUMMARY OF THE INVENTION

To overcome the deficiencies of the prior art and to achieve the objects listed above, the Applicant has invented a muzzle brake for a firearm for reducing the linear recoil associated with the firing of the firearm. In a preferred embodiment of the present invention, the muzzle brake is for use on a rifle and is rotatably adjustable between two positions: an open position where the linear recoil is reduced by approximately thirty percent; and a closed position where the recoil is not reduced. The adjustable muzzle brake comprises a cylindrical inner sleeve having internal threads formed at one end. The inner sleeve threadably engages screw threads formed on the muzzle end of the rifle barrel. The inner sleeve has an internal bore formed throughout its length. The diameter of the bore is slightly larger than the diameter of the rifle barrel. The opposite end of the inner sleeve has a flanged outer surface, as well as a pair of slotted recesses cut into a portion of the outer wall material of the inner sleeve. The slotted recesses are spaced one hundred eighty degrees apart from each other around the circumference of the outer surface of the inner sleeve. The inner sleeve also has a plurality of circular gas vent holes formed through the entire thickness of the inner sleeve wall material.

The muzzle brake also comprises a cylindrical outer sleeve having a plurality of circular gas vent holes formed through the wall material of the outer sleeve in a pattern similar to that of the vent holes formed in the inner sleeve. The outer sleeve is adaptable to fit over the inner sleeve and is constrained from linear travel along the axis of the rifle barrel by the flanged end surface of the inner sleeve and by a flanged surface at the end of the rifle barrel adjacent the screw threads formed thereon. An inner surface of the outer sleeve has a pair of detent channels formed therein and spaced one hundred eighty degrees apart from each other around the circumference of the inner surface of the outer sleeve. Each channel spans approximately thirty degrees of the circumference of the inner surface and has radiused ends flanking an intermediate flat portion. The radiused ends form longitudinal recesses that are at a depth of penetration of the outer sleeve material that is greater than the depth of penetration of the intermediate flat portion.

In assembly of the adjustable muzzle brake of the present invention, a pair of pins are disposed within the corresponding pair of slotted recesses in the inner sleeve. A portion of each pin protrudes above the outer surface of the inner sleeve. The outer sleeve is then fitted over the inner sleeve such that the protruding portion of each pin fits into one of the longitudinal recesses formed in the inner surface of the outer sleeve. The assembled muzzle brake is then screwed onto the end of the rifle barrel.

The pair of slotted recesses formed on the outer surface of the inner sleeve, the pair of detent channels formed on the inner surface of the outer sleeve and the pair of pins all form a pair of quick locator detent mechanisms. In operation, when the outer sleeve is rotated or twisted to an open position where each pin engages one of the two longitudinal recesses formed in each detent channel, the gas vent holes in both the inner and outer sleeves are aligned. When the rifle is fired, a portion of the gas propelling the bullet down the barrel escapes through the aligned gas vent holes in a direction transverse to the axis of the gun barrel, thereby reducing recoil by a predetermined amount. On the other hand, when the outer sleeve is twisted to a closed position where the gas vent holes in the sleeves do not line up, the gas cannot escape transverse to the gun barrel and, instead, it follows its normal path out of the muzzle end of the barrel, with no reduction of recoil.

The present invention provides the shooter of the rifle with an adjustable muzzle brake that is quickly and easily adjustable between two positions with a simple twist of the outer sleeve. With the muzzle brake in the open position, linear recoil is reduced by approximately thirty percent. With the muzzle brake in the closed position, there is no recoil reduction.

BRIEF DESCRIPTION OF THE DRAWINGS

FIG. 1 is a side elevational view of a commercially-available rifle having the adjustable muzzle brake of the present invention attached to the muzzle end of the gun barrel;

FIG. 2 is a side view, partially cut away to reveal cross-sectional portions of both the muzzle end of the gun barrel and the adjustable muzzle brake of the present invention physically separated from the muzzle end of the barrel;

DETAILED DESCRIPTION OF THE PREFERRED EMBODIMENTS

Figure 3:
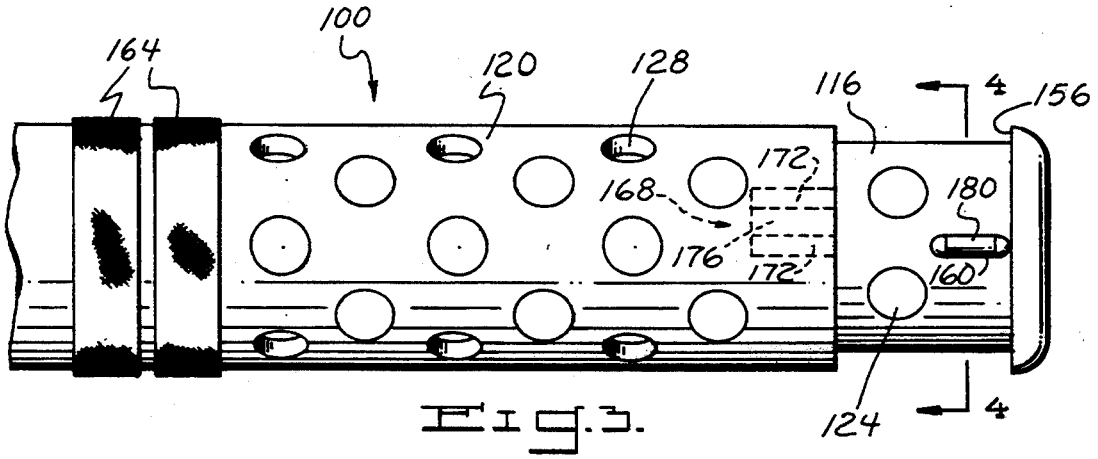
FIG. 3 is a side view of the adjustable muzzle brake of the present invention depicting the outer sleeve disassembled from the inner sleeve.

Referring to the drawings in detail, an adjustable muzzle brake for a rifle is illustrated therein and generally designated by the reference numeral 100. The muzzle brake 100 is threadably attached to a muzzle end 104 of a barrel 108 of a rifle 112, and comprises an inner sleeve 116 surrounded by an outer sleeve 120. Both sleeves 116, 120 have a plurality of circular holes 124, 128 formed through the sleeve walls. Two detent mechanisms 132 are provided which allow the outer sleeve 120 to be rotatable with respect to the inner sleeve 116 between two positions: an open position where the holes 124, 128 of both the inner and outer sleeves 116, 120 are in alignment with each other; and a closed position where the holes 124, 128 of the inner and outer sleeves 116, 120 are totally out of alignment with each other. In the open position, when a bullet is fired, the gases following the bullet down the barrel 108 are allowed to escape from the aligned holes 124, 128 of the inner and outer sleeves 116, 120. The gases escape in a substantially transverse direction to the axis of the rifle barrel 108. In the closed position, the gases are not allowed to escape through the holes 124, 128, and, instead, follow the bullet out of the end of the muzzle brake 100.

Referring now to FIG. 1, there illustrated is a commercially-available rifle 112, for example, the Model 116SE, available from Savage Arms, Inc., Westfield, Mass. The rifle 112 includes a barrel 108 whose muzzle end 104 is attached the adjustable muzzle brake 100 of the present invention. Referring also to FIG. 2, there illustrated is a partial cross-section of the muzzle brake 100 and the muzzle end 104 of the rifle barrel 108 in a partially cutaway view with the muzzle brake 100 disconnected from the barrel 108. The barrel 108 has an internal throughbore 136 through which the bullet passes as it exits the muzzle end 104. A portion of the wall material of the barrel 108 at the muzzle end 104 is reduced in thickness and threads 140 are formed thereon. A flanged surface 144 is formed in the barrel 108 material, typically a hardened stainless steel.

The inner sleeve 116 is cylindrical and has an internal throughbore 148 through which the bullet passes after it leaves the muzzle end 104 of the barrel 108. In an exemplary embodiment of the present invention, the diameter of the throughbore 148 of the inner sleeve 116 is slightly larger than that of the barrel throughbore 136; in this case, the difference is forty thousandths of an inch (0.040"). On an inner surface of the inner sleeve 116 toward the left end of the sleeve (i.e., the end near the muzzle end 104 of the barrel 108) are formed threads 152 that engage the threads 140 formed on the muzzle end 104 of the barrel 108. The inner sleeve 116 threadably engages the muzzle end 104 of the barrel 108 until the left end of the inner sleeve 116 contacts the flanged surface 144 on the barrel 108. The threaded design of both the inner sleeve 116 and the muzzle end 104 of the barrel 108 allows for an air-tight connection between the two, thus preventing any gases to undesirably escape at the connection.

Referring also to FIG. 3, the inner sleeve 116 has a series of circular holes 124 formed through the entire thickness of the wall of the inner sleeve 116. The holes 124 are formed in alternating rows that encompass the entire circumference of the inner sleeve 116. In the preferred embodiment of the present invention, the holes 124 are shown as circular; however, the holes 124 may be any shape if desired. Circular holes 124 provide for regular dissipation of the gases to pass therethrough, as described in greater detail hereinafter.

In a preferred embodiment of the present invention, the inner sleeve 116 has six rows of holes 124 formed around its circumference, the rows being alternately staggered. Each row contains six holes 124, and the diameter of each hole 124 is approximately 5/32 of an inch (0.156"). The centers of the six holes 124 in each row are spaced evenly around the circumference of the outer surface of the inner sleeve 116. Therefore, each hole 124 in the row is radially spaced sixty degrees apart.

At the right end of the inner sleeve 116 (i.e., the end opposite or furthest away from the muzzle end 104 of the barrel 108) is formed a flanged lip surface 156. The function of this flanged surface 156 will be described in greater detail hereinafter. As best seen in FIGS. 2 and 3, a pair of slotted recesses 160 are formed in the outer surface of the inner sleeve 116 proximate the flanged surface 156. The two recesses 160 are disposed equidistant around the circumference of the outer surface of the inner sleeve 116 (that is, one hundred eighty degrees apart from each other). In the preferred embodiment of the present invention, the recesses 160 are two hundred fifty thousandths of an inch (0.250") long, approximately sixty-two thousandths of an inch (0.062") wide and approximately ten thousandths of an inch (0.010") deep. However, these numbers are purely exemplary and may depend in part on the caliber of the rifle 112 itself. The inner sleeve 116 is machined using standard machining techniques and comprises a hardened stainless steel material, such as a type 416 stainless steel.

The muzzle brake 100 also includes a cylindrical outer sleeve 120 that fits over the inner sleeve 116 such that an inner surface of the outer sleeve 120 loosely contacts the outer surface of the inner sleeve 116. The outer sleeve 120 also has a plurality of circular holes 128 formed through its wall material. The holes 128 in the outer sleeve 120 are formed in the identical pattern and sizes as that of the holes 124 in the inner sleeve 116. The outer sleeve 120 is freely rotatable with respect to the inner sleeve 116, which is threadably fixed to the muzzle end 104 of the rifle barrel 108. In contrast, the outer sleeve 120 is not attached to the rifle barrel 108. A portion of the outer surface of the outer sleeve 120 is diamond knurled in two concentric rings 164 to facilitate the rotation of the outer sleeve 120 with respect to the inner sleeve 116. The outer sleeve 120 is prevented from any linear motion along the axis of the barrel 108 since the left end of the outer sleeve 120 abuts the flange 144 on the muzzle end 104 of the rifle barrel 108, while the right-hand side of the outer sleeve 120 abuts the flanged "lip" surface 156 formed on the right end of the inner sleeve 116. The outer sleeve 120 may be formed from a similar hardened stainless steel as that of the inner sleeve 116, such as the type 416 stainless steel. Preferably, however, the outer sleeve 120 is formed from a stainless steel that is somewhat softer than that of the inner sleeve 116, for reasons described hereinafter.

As best seen in FIGS. 2–5, the outer sleeve 120 has formed, on its inner surface, a pair of detent channels 168. The two detent channels 168 are disposed opposite each other around the circumference of the inner surface of the outer sleeve 120. That is, the channels 168 are disposed one hundred eighty degrees apart from each other. Each channel has a length that is approximately equal to that of the corresponding slotted recess 160 formed in the outer surface of the inner sleeve 116. However, the width of each channel 168, expressed as an angular or radial amount around the circumference of the inner surface of the outer sleeve 120, is approximately thirty degrees, which is greater than the radial width of each slotted recess 160. On each width end of each channel 168 is formed a longitudinal recess 172 similar in size to the corresponding slotted recesses 160 formed on the outer surface of the inner sleeve 116. Disposed between the two longitudinal recesses 172 of each channel is an intermediate portion 176 having a generally flat surface. The intermediate portion 176 is formed to a depth of penetration into the inner surface of the outer sleeve 120 that is less than the depth of penetration of the two longitudinal recesses 172 that flank the corresponding intermediate portion 176.

The muzzle brake 100 of the present invention also includes a pair of pins 180 that are generally cylindrical in shape. Each pin 180 is designed to fit into the corresponding slotted recess 160 formed in the outer surface of the inner sleeve 116, and into one of the two longitudinal recesses 172 formed in the inner surface of the outer sleeve 120. The pins 180 comprise a hardened stainless steel material similar to that of the inner sleeve 116, such as the type 416 stainless steel.

In assembling the adjustable muzzle brake 100 of the present invention, a first pin 180 is placed in one slotted recess 160 in the outer surface of the inner sleeve 116, while the second pin 180 is placed into a second slotted recess 160 in the outer surface of the inner sleeve 116, and both pins 180 are held there by finger pressure. The end of the outer sleeve 120 opposite the end having the knurled rings 164 is then slid over the inner sleeve 116. The outer sleeve 120 is slid along the inner sleeve 116 until the two detent channels 168 are lined up with the pins 180 and corresponding slotted recesses 160 formed in the outer surface of the inner sleeve 116 such that the top of each pin 180 protruding above the outer surface of the inner sleeve 116 fits into one of the two corresponding longitudinal recesses 172 formed in each detent channel 168 and the outer sleeve 120 abuts the lip 156 of the inner sleeve 116. The assembled muzzle brake 100 may then be screwed onto the muzzle end 104 of the rifle barrel 108.

Figure 4:
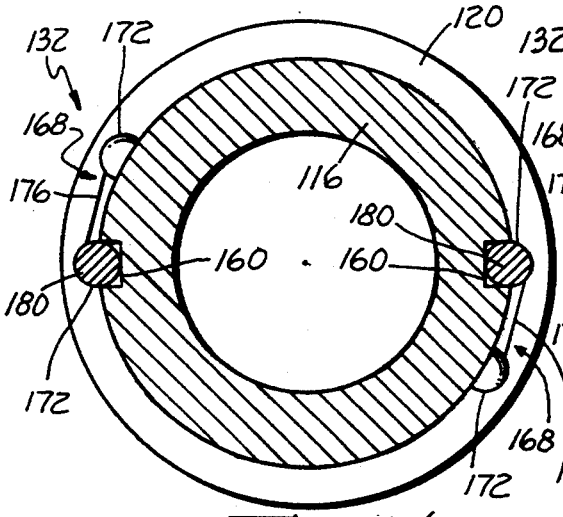
FIG. 4 is a cross-sectional view of the outer and inner sleeves, together with the quick locator detent mechanism of the present invention in a first position, taken along the lines 4—4 of FIG. 3.
Figure 5:
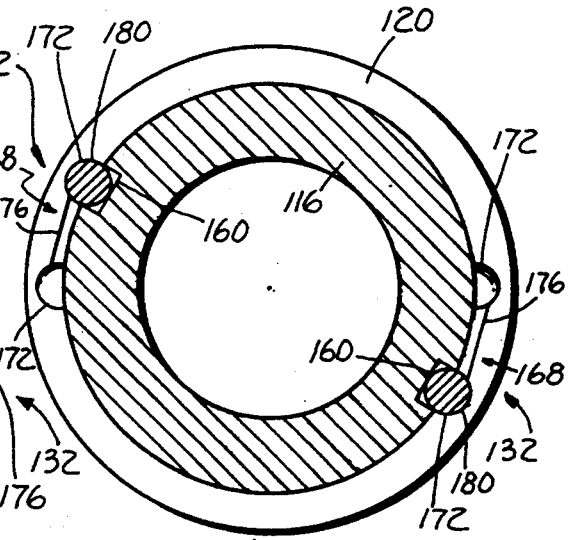
FIG. 5 is a cross-sectional view similar to that of FIG. 4 with the quick locator detent mechanism in a second position.
Figure 6:
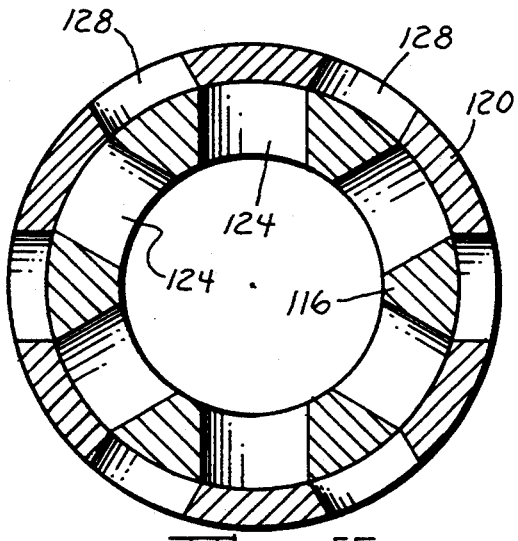
FIG. 6 is a cross-sectional view along the axis of the adjustable muzzle brake of the present invention depicting the vent ports of the inner sleeve in a non-aligned position with the vent ports of the outer sleeve when the detent mechanism is in the first position of FIG. 4.

As best seen in FIGS. 4 and 5, when assembled as hereinbefore described, the pins 180 occupy the corresponding slotted recesses 160 formed in the outer surface of the inner sleeve 116 and one of the two longitudinal recesses 172 formed in the corresponding detent channels 168 formed in the inner surface of the outer sleeve 120. For example, FIGS. 4 and 6 illustrate each pin 180 disposed in one longitudinal recess 172 of the corresponding detent channel 168 such that the holes 124 formed in the inner sleeve 116 do not line up with the holes 128 formed in the outer sleeve 120. This position is referred to as the "closed" position of the adjustable muzzle brake 100 of the present invention.

To achieve a second position of the muzzle brake 100, in which the holes 124 of the inner sleeve 116 are aligned with the holes 128 of the outer sleeve 120, the outer sleeve 120 is rotated with respect to the inner sleeve 116 by applying finger pressure to the outer sleeve 120, such finger pressure being facilitated by the knurled rings 164 of the outer surface of the outer sleeve 120. The outer sleeve 120 is rotatable approximately thirty degrees such that the pins 180 exit the first longitudinal recess 172 of each detent channel 168, pass along the relatively flat intermediate portion 176 of the detent channel 168, and then "drop into" the second longitudinal recess 172 of each detent channel 168. As the outer sleeve 120 is being rotated through its entire approximate thirty degree angular range of movement, the pins 180 cause the relatively flat and shallow intermediate portion 172 of the corresponding detent channels 168 to deform slightly. This is because the outer sleeve 120 is formed from a somewhat softer material than that of the inner sleeve 116 and the pins 180. In the preferred embodiment of the present invention, the amount of deformation is two to three thousandths of an inch (0.002"–0.003"). Also, with no rotation of the outer sleeve 120, the design of two longitudinal recesses 172 of each detent channel 168 cause the pins 180 to remain within one of the recesses 172 at all times, unless sufficient pressure is applied to the outer sleeve 120 to turn the outer sleeve 120 with respect to the inner sleeve 116 and overcome the detent formed by the different depths of penetration of the longitudinal recesses 172 and the intermediate flat portion 176.

Figure 7:
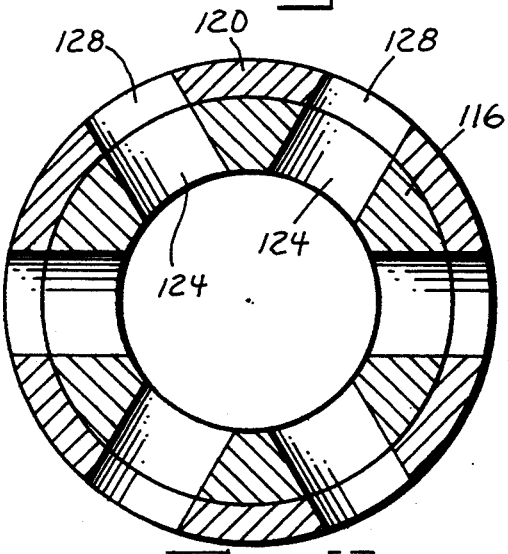
FIG. 7 is a cross-sectional view of the adjustable muzzle brake of the present invention showing the gas vent holes of the inner sleeve aligned with the gas vent holes of the outer sleeve when the detent mechanism is in the second position of FIG. 5.

It has been determined experimentally that the number, size and pattern of the holes 124, 128 formed in both the inner and outer sleeves 116, 120 provide for an approximate thirty percent reduction in the amount of recoil force when the muzzle brake 100 is equipped on the aforementioned Model 116SE rifle 112 provided by Savage Arms, Inc. This recoil reduction is a result of the holes 128 in the outer sleeve 120 aligning with the holes 124 in the inner sleeve 116; that is, when the outer sleeve 120 is rotated such that the pins 180 are in the position shown in FIG. 5. When the rifle 112 is fired, the expanding gases that propel the bullet down the rifle barrel 108 follow the bullet closely down the barrel 108 until the bullet and gases reach the muzzle brake 100 of the present invention. Then the gases escape through the aligned holes 124, 128 in the inner and outer sleeves 116, 120 out to the ambient atmosphere, as illustrated in FIG. 7. The gases escape in directions which are essentially transverse to the axis of the barrel 108. It has been further discovered experimentally that the approximate thirty percent reduction in recoil force has only an approximately four percent reduction in the amount of energy propelling the bullet out of the muzzle brake 100 and toward its intended target. A larger reduction in the amount of recoil force could have been achieved; however, it would have come at a greater loss of energy behind the bullet.

The present invention has been described as having two detent mechanisms 132 comprising the pins 180, the two slotted recesses 160 formed in the outer surface of the inner sleeve 116, and the detent channels 168 formed in the inner surface of the outer sleeve 120. Further, such detent mechanisms 132 have been positioned equidistant around the circumference of the sleeves 116, 120. However, it is to be understood that the present invention is not limited to two detent mechanisms 132; three or more detent mechanisms 132 may be used, in light of the teachings herein, without departing from the broadest scope of the present invention. If three or more detent mechanisms 132 are used, they should all be spaced equidistant around the circumference of the sleeves 116, 120. Further, the detent mechanisms 132 have been illustrated and described as being located near the front or exit end of the adjustable muzzle brake 100. However, it is to be understood that the detent mechanisms 132 could be placed anywhere along the length of the sleeves 116, 120 without departing from the broadest scope of the present invention. Also, it has been described that the inner sleeve 116 is threadably attached to the muzzle end 104 of the rifle barrel 108 and the outer sleeve 120 is freely rotatable with respect to the inner sleeve 116 and is limited in its linear travel along the axis of the barrel 108. However, it is to be understood that, instead, the outer sleeve 120 may be attached to the end of the barrel 108 and the inner sleeve 116 may rotate freely with respect to the outer sleeve 120.

Further, the adjustable muzzle brake 100 of the present invention has been described for use on a rifle 112, in conjunction with a preferred embodiment. However, the broadest scope of the invention is not limited as such. The muzzle brake 100 may be utilized as a part of other types of firearms, such as shotguns and handguns.

It should be understood by those skilled in the art that obvious structural modifications can be made without departing from the spirit of the invention. Accordingly, reference should be made primarily to the accompanying claims, rather than the foregoing specification, to determine the scope of the invention.

Having thus described the invention, what is claimed is:

1. An adjustable muzzle brake attached to a muzzle end of a barrel of a firearm, comprising:

a. an inner sleeve having a cylindrical throughbore formed throughout a length of the inner sleeve, the inner sleeve having a plurality of boreholes formed entirely therethrough in a predetermined pattern;

b. an outer sleeve disposed over the inner sleeve and having a throughbore formed throughout a length of the outer sleeve, the outer sleeve having a plurality of boreholes formed entirely therethrough in the predetermined pattern similar to that of the boreholes formed in the inner sleeve; and c. means for rotatably positioning the outer sleeve with respect to the inner sleeve between two positions, a first one of the two positions being where the outer sleeve boreholes are aligned with the inner sleeve boreholes and a second one of the two positions being where the outer sleeve boreholes are not aligned with the inner sleeve boreholes, wherein the means for rotatably positioning comprises a detent mechanism comprising a slotted recess formed in an outer surface of the inner sleeve and a detent channel formed in an inner sleeve and a detent channel formed in an inner surface of the outer sleeve, the detent channel includes two longitudinal recesses formed on each radial end of the detent channel to a first predetermined depth below the inner surface of the outer sleeve, the detent channel also includes an intermediate portion between the two longitudinal recesses, each detent mechanism also includes a pin disposed in the slotted recess and in the detent channel, when the outer sleeve is in the first position with respect to the inner sleeve the pin is disposed in a first one of the two longitudinal recesses of the detent channel, when the outer sleeve is in the second position with respect to the inner sleeve the pin is disposed in a second one of the two longitudinal recesses of the detent channel, wherein the pin remains stationary in a direction transverse to an axis of the firearm barrel during any rotatable positioning of the outer sleeve with respect to the inner sleeve between the two positions.

2. The muzzle brake of claim 1, wherein the means for rotatably positioning the outer sleeve with respect to the inner sleeve comprises at least two detent mechanisms.

3. The muzzle brake of claim 2, wherein the detent mechanisms are spaced equidistant around the circumference of both the inner and outer sleeves.

4. The muzzle brake of claim 1, wherein the intermediate portion is formed at a second predetermined depth below the inner surface of the outer sleeve that is less than the first predetermined depth.

5. The muzzle brake of claim 1, wherein the inner sleeve is threadably attached to the muzzle end of the firearm barrel.

6. The muzzle brake of claim 1, wherein the plurality of boreholes in the inner sleeve and the plurality of boreholes in the outer sleeve are both circular in shape.

7. The muzzle brake of claim 1, wherein an outer end of the inner sleeve has a flanged surface formed thereon, the flanged surface being operable to prevent any linear movement of the outer sleeve with respect to the inner sleeve along the axis of the firearm barrel.

8. In a rifle having a barrel and an adjustable muzzle brake removably attachable to a muzzle end of the barrel, the variable muzzle brake comprising an inner sleeve disposed within an outer sleeve, the outer sleeve being rotatable with respect to the inner sleeve, both the inner sleeve and the outer sleeve having a plurality of throughbores formed therein in predetermined patterns, wherein the improvement comprises: at least two quick locator detent mechanisms, each detent mechanism comprising a slotted recess formed in an outer surface of the inner sleeve and a detent channel formed in an inner surface of the outer sleeve, the detent channel includes two longitudinal recesses formed on each radial end of the detent channel to a first predetermined depth below the inner surface of the outer sleeve, and an intermediate portion between the two longitudinal recesses, the intermediate portion being formed at a second predetermined depth below the inner surface of the outer sleeve that is less than the first predetermined depth, each detent mechanism also includes a pin disposed in the slotted recess and in the detent channel, when the outer sleeve is in the first position with respect to the inner sleeve the pin is disposed in a first one of the two longitudinal recesses of the detent channel, when the outer sleeve is in the second position with respect to the inner sleeve the pin is disposed in a second one of the two longitudinal recesses of the detent channel, wherein the pin remains stationary in a direction transverse to an axis of the rifle barrel during any radial positioning rotatably of the outer sleeve with respect to the inner sleeve between the two positions.

9. An adjustable muzzle brake adaptable to be attached in an adjacent and abutting relation to a muzzle end of a rifle barrel, the muzzle brake operable to reduce an amount of recoil force encountered by a shooter of the rifle upon firing of the rifle, the muzzle brake comprising:

a. a cylindrical inner sleeve having a cylindrical internal throughbore through which a bullet fired by the rifle passes through as the bullet travels down the rifle barrel and out of the muzzle end of the barrel, the inner sleeve having one or more holes formed therethrough;

b. a cylindrical outer sleeve disposed over the inner sleeve and having one or more holes formed therethrough, the outer sleeve and inner sleeve being rotatable with respect to each other; and c. at least two detent mechanisms operable to position the outer and inner sleeves in at least two radial positions with respect to each other, a first radial position having the one or more holes of the inner sleeve in full alignment with the one or more holes of the outer sleeve, the second radial position having the one or more holes of the inner sleeve in total misalignment with the one or more holes of the outer sleeve, each detent mechanism comprises a slotted recess formed in an outer surface of the inner sleeve and a detent channel formed in an inner surface of the outer sleeve, the detent channel includes two longitudinal recesses formed on each radial end of the detent channel to a first predetermined depth below the inner surface of the outer sleeve, and an intermediate portion between the two longitudinal recesses, each detent mechanism also includes a pin disposed in the slotted recess and in the detent channel, when the outer sleeve is in the first position with respect to the two inner sleeve the pin is disposed in a first one of the two longitudinal recesses of the detent channel, when the outer sleeve is in the second position with respect to the inner sleeve the pin is disposed in a second one of the two detent channels, wherein the pin remains stationary in a direction transverse to an axis of the rifle barrel during any radial positioning rotatably of the outer sleeve with respect to the inner sleeve between the two positions.

10. The adjustable muzzle brake of claim 9, wherein the at least two detent mechanisms are spaced equidistant around the circumference of both the inner and outer sleeves.

11. The adjustable muzzle brake of claim 9, wherein the inner sleeve is threadably attached to the muzzle end of the rifle barrel.

12. The adjustable muzzle brake of claim 9, wherein the one or more holes formed in the inner sleeve and the one or more holes formed in the outer sleeve are both circular in shape.

13. The adjustable muzzle brake of claim 9, wherein an outer end of the inner sleeve has a flanged surfaced formed thereon, the flanged surface being operable to prevent any linear movement of the outer sleeve with respect to the inner sleeve along the axis of the rifle barrel.

* * * * *